US007340807B2

(12) United States Patent
Dais et al.

(10) Patent No.: US 7,340,807 B2
(45) Date of Patent: Mar. 11, 2008

(54) POUCH AND RESEALABLE CLOSURE MECHANISM THEREFOR INCLUDING A PLURALITY OF INTERLOCKING CLOSURE ELEMENTS

(75) Inventors: Brian C. Dais, Saginaw, MI (US); Robert R. Turvey, Sanford, MI (US)

(73) Assignee: S.C. Johnson Home Storage, Racine, WI (US)

( * ) Notice: Subject to any disclaimer, the term of this patent is extended or adjusted under 35 U.S.C. 154(b) by 124 days.

(21) Appl. No.: 11/047,002

(22) Filed: Jan. 31, 2005

(65) Prior Publication Data

US 2006/0168776 A1 Aug. 3, 2006

(51) Int. Cl.
*A44B 18/00* (2006.01)
*B65D 33/24* (2006.01)

(52) U.S. Cl. ..... 24/443; 383/63

(58) Field of Classification Search ..... 383/61.1, 383/61.2, 63; 24/403, 306, 443
See application file for complete search history.

(56) References Cited

U.S. PATENT DOCUMENTS

| | | | | | |
|---|---|---|---|---|---|
| 2,499,898 | A | | 3/1950 | Anderson | 24/206 |
| 2,715,759 | A | | 8/1955 | Poux | 24/20 |
| 2,791,807 | A | | 5/1957 | Morin | 18/59 |
| 2,886,085 | A | | 5/1959 | Sanger | 150/1.6 |
| 2,994,117 | A | | 8/1961 | McMullin | 24/201 |
| 3,338,285 | A | | 8/1967 | Jaster | 150/3 |
| 3,343,233 | A | | 9/1967 | Gould | 24/400 |
| 3,403,429 | A | * | 10/1968 | Smith | 24/306 |
| 3,462,332 | A | | 8/1969 | Goto | 156/244 |
| 3,464,094 | A | * | 9/1969 | Mates | 24/443 |
| 3,557,413 | A | | 1/1971 | Engle | 24/201 |
| 3,608,439 | A | | 9/1971 | Ausnit | 93/35 R |
| 3,679,511 | A | | 7/1972 | Ausnit | 156/251 |
| 3,679,531 | A | | 7/1972 | Wienand et al. | 161/48 |
| 3,808,648 | A | | 5/1974 | Billarant et al. | 24/204 |
| 4,187,068 | A | | 2/1980 | Vassar | 425/381 |
| 4,212,337 | A | | 7/1980 | Kamp | 150/3 |
| 4,256,685 | A | | 3/1981 | Vassar | 264/167 |
| 4,419,159 | A | | 12/1983 | Herrington | 156/66 |
| 4,426,816 | A | * | 1/1984 | Dean et al. | 52/202 |
| 4,430,070 | A | | 2/1984 | Ausnit | 493/215 |
| 4,522,678 | A | | 6/1985 | Zieke | 156/501 |
| 4,540,537 | A | | 9/1985 | Kamp | 264/171 |
| 4,603,434 | A | | 7/1986 | Herrington | 383/95 |
| 4,665,557 | A | | 5/1987 | Kamp | 383/63 |
| 4,701,358 | A | | 10/1987 | Behr et al. | 428/35 |
| 4,755,248 | A | | 7/1988 | Geiger et al. | 156/244.25 |
| 4,787,880 | A | | 11/1988 | Ausnit | 493/213 |
| 4,812,056 | A | | 3/1989 | Zieke | 383/65 |
| 4,829,641 | A | | 5/1989 | Williams | 24/587 |
| 4,929,225 | A | | 5/1990 | Ausnit et al. | 493/213 |
| 4,929,487 | A | | 5/1990 | Tilman et al. | 428/163 |
| 5,081,748 | A | * | 1/1992 | Eberle | 24/442 |
| 5,088,162 | A | | 2/1992 | Allan | 24/442 |
| 5,088,164 | A | | 2/1992 | Wilson et al. | 24/584.1 |
| 5,097,570 | A | | 3/1992 | Gershenson | 24/452 |
| 5,113,555 | A | | 5/1992 | Wilson et al. | 24/576 |

(Continued)

*Primary Examiner*—Jack W. Lavinder

(57) ABSTRACT

A resealable closure mechanism includes first and second closure strips. The first closure strip includes a plurality of discontinuous closure elements and the second closure strip includes a plurality of discontinuous closure elements. One or more of the discontinuous closure elements of the first closure strip randomly engages one or more of the discontinuous closure elements of the second closure strip.

16 Claims, 6 Drawing Sheets

U.S. PATENT DOCUMENTS 5,172,980 A * 12/1992 Provost ..... 383/204
5,179,767 A 1/1993 Allan ..... 24/442
5,189,765 A 3/1993 Singhal ..... 24/400
5,209,574 A 5/1993 Tilman ..... 383/63
5,211,481 A 5/1993 Tilman ..... 383/63
5,216,787 A 6/1993 Custer et al. ..... 24/587
5,219,588 A 6/1993 England et al. ..... 425/189
5,242,646 A 9/1993 Torigoe et al. ..... 264/219
5,259,904 A 11/1993 Ausnit ..... 156/244.15
5,273,511 A * 12/1993 Boeckman ..... 493/195
5,293,672 A 3/1994 Tominaga et al. ..... 24/587
5,343,659 A 9/1994 Zaleski ..... 52/24
5,369,847 A 12/1994 Naya et al. ..... 24/30.5 R
5,371,925 A 12/1994 Sawatsky ..... 24/30.5 R
5,384,942 A 1/1995 Siegel ..... 24/587
5,403,094 A 4/1995 Tomic ..... 383/63
5,480,030 A 1/1996 Sweeny et al. ..... 206/524.8
5,509,734 A 4/1996 Ausnit ..... 383/63
5,527,112 A 6/1996 Dais et al. ..... 383/211
5,614,232 A 3/1997 Torigoe et al. ..... 425/545
5,686,163 A * 11/1997 Tsubata et al. ..... 428/99
5,747,126 A 5/1998 Van Erden et al. ..... 428/35.2
5,797,170 A 8/1998 Akeno ..... 24/452
5,878,468 A * 3/1999 Tomic et al. ..... 24/585.12
5,890,810 A 4/1999 Barlow ..... 383/120
5,933,927 A 8/1999 Miller et al. ..... 24/452
5,944,425 A 8/1999 Forman ..... 383/61
5,988,492 A 11/1999 Capy et al. ..... 229/122.34
6,080,252 A 6/2000 Plourde ..... 156/66
6,082,897 A 7/2000 Galomb ..... 383/63
6,138,329 A 10/2000 Johnson ..... 24/587
6,154,934 A 12/2000 Matthews ..... 24/587
6,185,796 B1 2/2001 Ausnit ..... 24/587
6,367,976 B1 4/2002 Bannister ..... 383/85
6,519,918 B2 2/2003 Forman et al. ..... 53/412
6,789,946 B2 9/2004 Plourde et al. ..... 383/63
6,851,161 B2 * 2/2005 Kingsford et al. ..... 24/306
6,991,375 B2 * 1/2006 Clune et al. ..... 383/206
2002/0168118 A1 11/2002 Price ..... 383/64
2003/0031386 A1 * 2/2003 Shepard et al. ..... 383/61.1
2003/0138170 A1 * 7/2003 Breil, Jr. ..... 383/59
2003/0219174 A1 11/2003 Piechocki ..... 383/59
2004/0001650 A1 1/2004 Piechocki et al. ..... 383/59
2004/0001651 A1 * 1/2004 Pawloski ..... 383/63
2004/0013323 A1 1/2004 Withers ..... 383/63
2004/0052434 A1 3/2004 Bell ..... 383/35
2004/0058103 A1 3/2004 Anderson et al. ..... 428/34.1
2004/0066988 A1 4/2004 Yi ..... 383/120
2004/0136618 A1 7/2004 Ausnit et al. ..... 383/64

* cited by examiner

POUCH AND RESEALABLE CLOSURE MECHANISM THEREFOR INCLUDING A PLURALITY OF INTERLOCKING CLOSURE ELEMENTS

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

BACKGROUND OF THE INVENTION

1. Field of the Invention

The present invention relates generally to a closure mechanism having a plurality of interlocking closure elements.

2. Description of the Background of the Invention

A thermoplastic pouch in the form of a bag for the storage of items generally includes a closure mechanism, which comprises two separate closure strips attached to inner surfaces of opposing pouch walls. A first closure strip typically comprises one or more continuous closure elements of various cross-sectional shapes that interlock with one or more closure elements of a second opposing closure strip. These closure mechanisms are known in the art.

In some instances, a bag includes a clasp having first and second complementary clasp members. Each of the clasp members includes a plurality of prongs thereon that are spaced uniformly in transverse and longitudinal rows, wherein the prongs of one clasp member are spaced twice as far apart as the prongs of the other clasp member. The prongs of one clasp member are received by sockets formed between the prongs of the opposite clasp member to interlock the two clasp members.

In other instances, a bag includes a first closure having one or more omega-shaped elements and a second closure having a plurality of omega-shaped elements. Each omega-shaped element of the first closure engages any two adjacent omega-shaped elements of the second closure, thereby allowing multiple options for closure thereof.

A bag in some instances has a reclosable zipper including first and second base members each having a plurality of interlocking zipper profile parts extending therefrom. One of the profile parts has a larger head than the heads of the other profile parts to resist opening of the zipper due to internal pressures.

In further instances, a bag includes a closure strip for sealing an open end of the bag. The closure strip includes hook and loop fastener elements each in the form of an elongated tape.

SUMMARY OF THE INVENTION

According to one aspect of the present invention, a resealable closure mechanism comprises first and second closure strips. The first closure strip includes a plurality of discontinuous closure elements and the second closure strip includes a plurality of discontinuous closure elements. One or more of the discontinuous closure elements of the first closure strip randomly engages one or more of the discontinuous closure elements of the second closure strip.

According to a further aspect of the present invention, a resealable closure mechanism comprises first and second opposing bag walls. The first closure strip includes a plurality of discontinuous closure elements and the second closure strip includes at least one continuous closure element. The at least one continuous closure element of the second closure strip randomly engages one or more of the discontinuous closure elements of the first closure strip.

Other aspects and advantages of the present invention will become apparent upon consideration of the following detailed description. Like reference numerals in the drawings designate like structures in the various embodiments.

DETAILED DESCRIPTION OF THE PREFERRED EMBODIMENTS

The present invention is directed toward apparatuses, methods, kits, and combinations for opening and/or closing a resealable pouch. While the present invention may be embodied in many different forms, several specific embodiments are discussed herein with the understanding that the present disclosure is to be considered only as an exemplification of the invention and is not intended to limit the invention to the embodiments illustrated. For example, where the invention is illustrated herein with particular reference to a resealable pouch, it will be understood that any other resealable pouch, such as a thermoplastic pouch, a container, or bag (for example a paper, plastic, or foil bag) can, if desired, be substituted in whole or in part for the resealable pouch in the apparatuses, methods, kits, and combinations herein described.

It has been discovered that the closure strips described herein are unique and exhibit several advantages as closure mechanisms. Such closure strips exhibit improved ease of use by providing multiple paths along which the closure strips may be interlocked. The closure mechanisms may be provided separately as standalone reclosable fasteners, wherein each closure strip may be provided with an adhesive backing. Alternatively, the closure strips may be provided already affixed to a container, such as a reclosable pouch.

Figure 1:
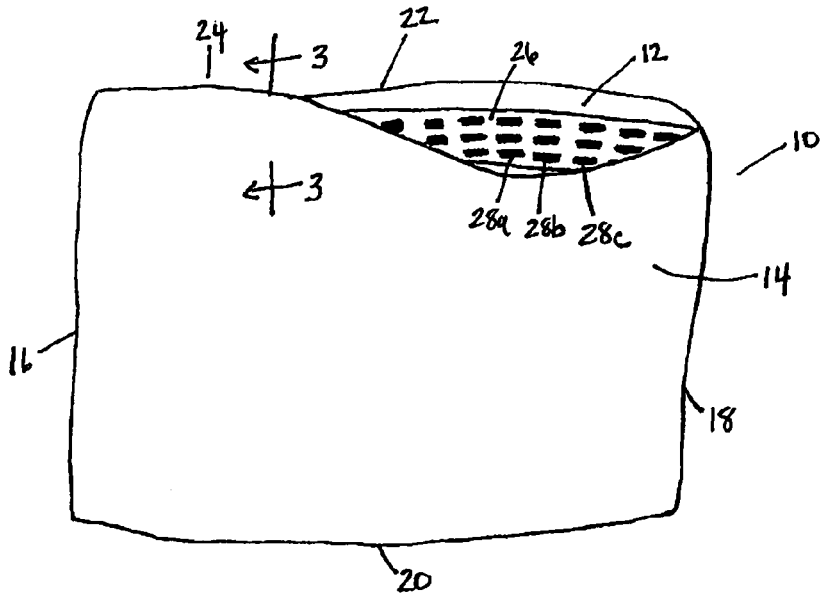
FIGS. 1 and 2 are isometric views of reclosable pouches according to the present invention shown in a partially opened position.

Referring now to FIG. 1, a resealable pouch in the form of a thermoplastic storage bag 10 comprises first and second bag walls 12, 14. The first and second bag walls 12, 14 are joined at first and second side portions 16, 18, respectively, and at a bottom portion 20. An opening 22 is formed at a top portion 24 of the bag 10. A first closure strip 26, extending from the first side portion 16 to the second side portion 18, is secured to the inside surface of the first bag wall 12. A second closure strip (not shown), similar to the first closure strip 26, extends from the first side portion 16 to the second side portion 18 and is secured to the inside surface of the second bag wall 14. The first closure strip 26 and the second closure strip (not shown) are disposed near the top portion 24 of the bag 10 and together comprise a closure mechanism for the bag.

Figure 2:
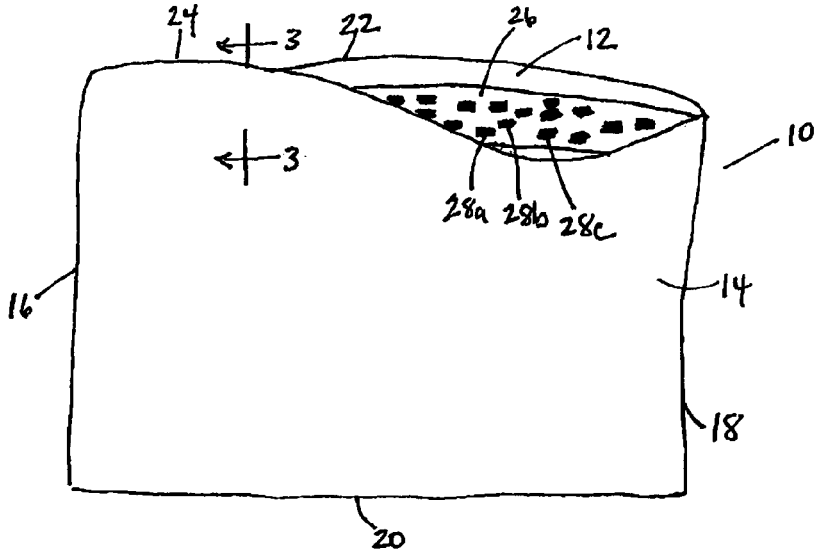

In a first embodiment, the first closure strip 26 and the second closure strip (not shown) include a plurality of discontinuous closure elements, e.g., 28*a*-28*c*, which may be arranged in columns extending along a height of the bag 10 and may further be arranged in rows extending along a width of the bag (hereinafter referred to as a "linear pattern"). Alternatively, the discontinuous closure elements, e.g., 28*a*-28*c*, of the first closure strip 26 and the second closure strip (not shown) may be placed on the closure strips in a random fashion, (hereinafter referred to as a "random pattern"), as shown in FIG. 2, and may comprise a series of hooks as in conventional hook 'n loop closures or button-head closures, as provided in the 3M™ Dual Lock™ Reclosable Fastener. And yet alternatively, the first closure strip 26 may be configured in a linear pattern as depicted in FIG. 1 or a random pattern as depicted in FIG. 2 and the second closure strip (not shown) may comprise one or more continuous closure elements, which extend from the first side portion 16 to the second side portion 18.

Although any number and size of discontinuous closure elements, e.g., 28*a*-28*c* (FIGS. 1 and 2), may be utilized, it is preferable to use elements having a minimal size to reduce the amount of material needed to produce the bag 10. For example, each closure element, e.g., 28*a*-28*c*, may extend 0.035"-0.040" in a somewhat perpendicular direction from the inside surface of the first bag wall 12. In addition, the closure elements of the second closure strip (not shown) may extend 0.035"-0.040" in a somewhat perpendicular direction from the inside surface of the second bag wall 14. However, the closure elements could extend a distance less than 0.035" or a distance greater than 0.040".

A user may close the bag 10 by contacting first and second bag walls 12, 14 over the first closure strip 26 and second closure strip (not shown) at the first side portion 16 of the bag using the thumb and a finger, pinching the area over the first and second closure strips and sliding the thumb and finger across the bag to the second side portion 18, thereby randomly interlocking at least one of the discontinuous closure elements of the first closure strip with at least one of the discontinuous, or alternatively, continuous, closure elements of the second closure strip along one of multiple closure paths. Because multiple closure paths exist, it is not necessary for a consumer to line up the closure strips in order to close the bag 10. And while it is preferable that a majority of the closure elements of the first closure strip engage a majority of the closure elements of the second closure strip upon closure, it is not necessary. The closure details will become more apparent in later FIGS.

It may be desirable to add features to the first and second closure strips, which help indicate complete closure of the bag to the consumer. One method is to add a first color to closure elements of the first closure strip 26 and a second color to closure elements of the second closure strip 40, wherein a third color is formed upon closure. An alternative method is intermittent deformation of the closure elements with a deforming wheel. This produces a tactile and/or audible sensation when the closure strips are closed. A further alternative method is to stagger deformations so that a checkerboard pattern is produced on the interlocked closure strips.

Figure 2A:
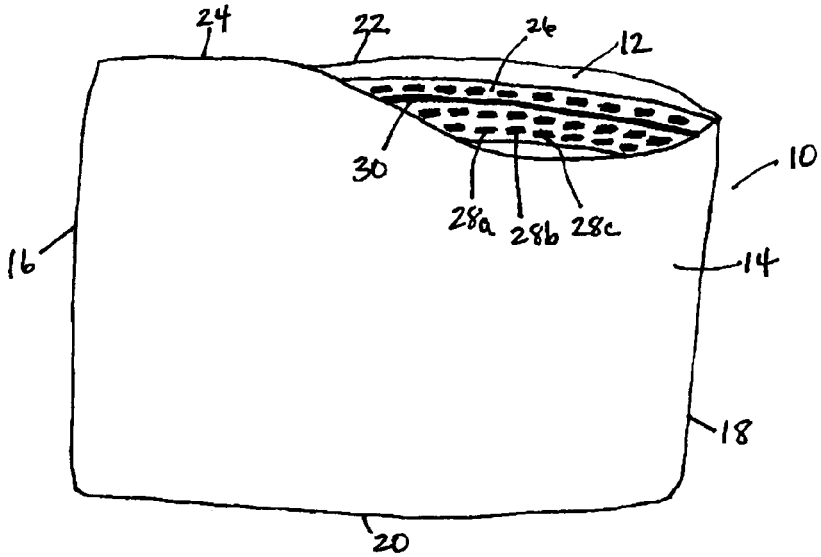
FIG. 2A-2C are isometric views of alternative embodiments of the pouches of FIGS. 1 and 2.
Figure 2B:
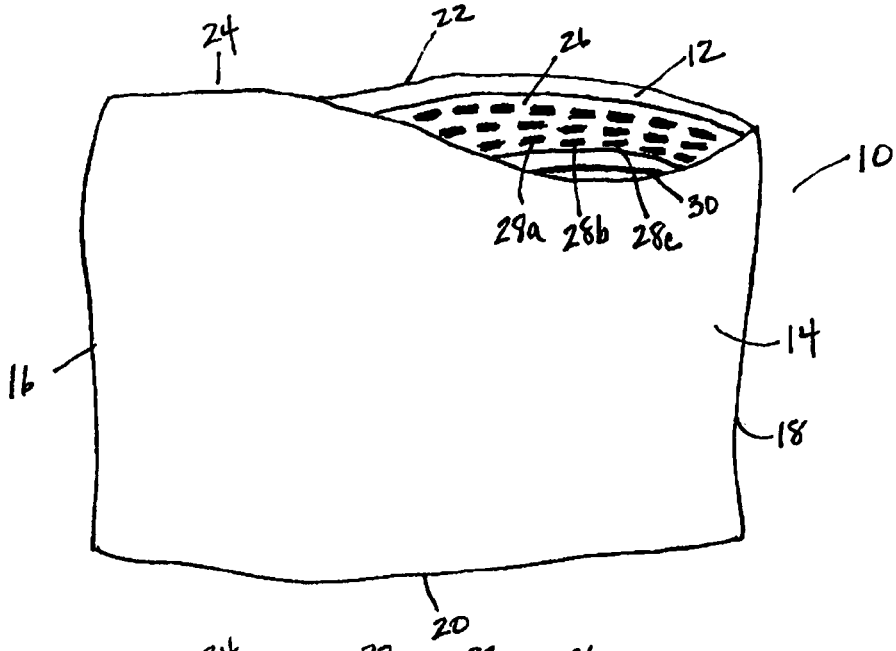
Figure 2C:
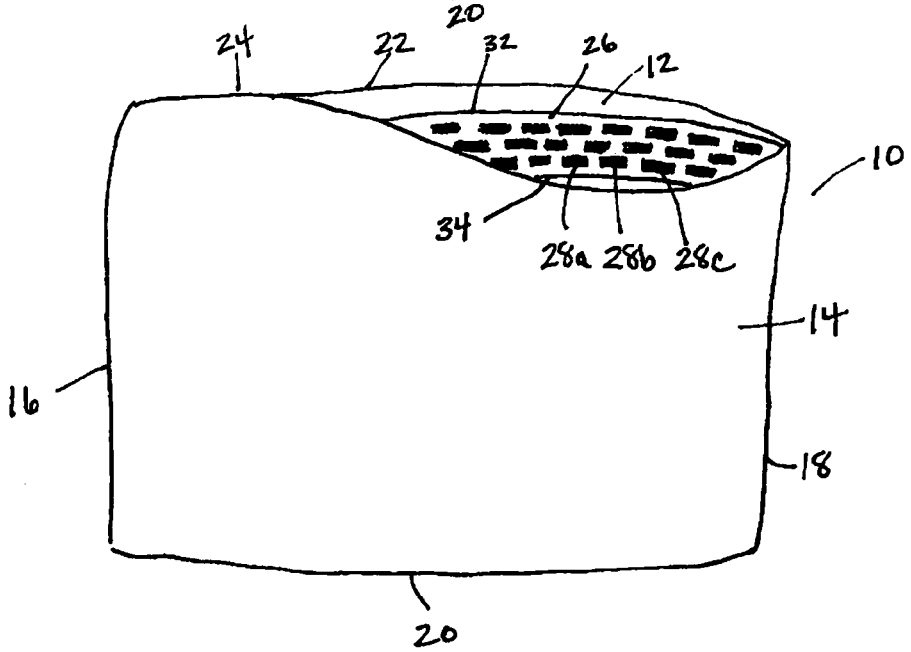

FIGS. 2A-2C depict alternative embodiments of the bags of FIGS. 1 and 2, wherein various structures are added to the bag 10, bag walls 12, 14, or closure strips, e.g., 26, or where, alternatively, the configuration or positioning of the closure elements, e.g., 28*a*-28*c*, is altered to form a leakproof seal when the bag is closed.

Referring specifically to FIG. 2A, first bag wall 12 further includes one or more continuous elements, for example, a continuous element 30, disposed on the first closure strip 26 and extending from the first side portion 16 to the second side portion 18 of the bag 10 to form a leakproof seal when the bag is closed. Preferably, although not necessarily, the second bag wall 14 additionally includes one or more continuous elements (not shown) disposed on the second closure strip (not shown). The one or more continuous elements, for example, continuous element 30, may, alternatively, be disposed adjacent the first closure strip 26 as depicted in FIG. 2B. Additionally, one or more continuous elements (not shown) may be disposed adjacent the second closure strip (not shown). The one or more continuous elements of each of the first bag wall 12 and the second bag wall 14 may be adjacent one another when the bag is closed or, alternatively, the continuous elements may be closure elements and may interlock when the bag 10 is closed. Further, the continuous elements will preferably comprise a polyolefin material such as polyethylene, polypropylene or thermoplastic elastomer, but alternatively, they could comprise any other material such as foam or gel.

According to FIG. 2C, an alternative configuration to prevent content leakage is shown. The discontinuous closure elements, e.g., 28*a*-28*c*, of the first closure strip 26, may be arranged so that the elements of the columns extending along a height of the bag 10 are staggered. In this arrangement, there is no straight passage from a top portion 32 of the first closure strip 26 to a bottom portion 34 of first closure strip, or from the bottom portion 34 to the top portion 32. The second closure strip (not shown) may be arranged in a similar fashion.

Figure 3:
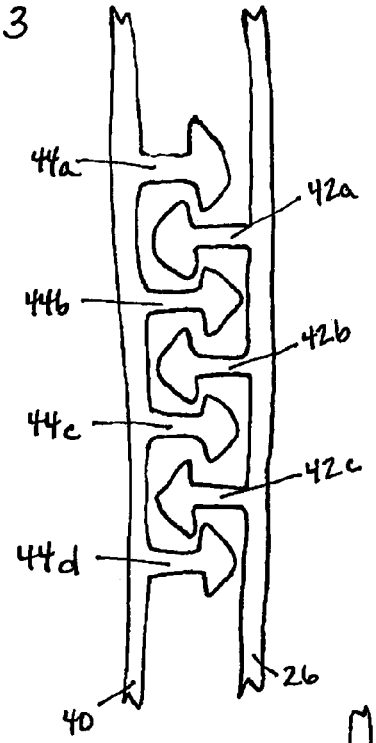
FIG. 3 is an enlarged, fragmentary, cross-sectional view taken generally along the lines 3-3 of FIG. 1 or FIG. 2 with the closure strips interlocked.

FIG. 3 is a partial cross-sectional view taken generally along the lines 3-3 of FIG. 1 or FIG. 2 with the first and second closure strips 26, 40 interlocked. According to FIG. 3, discontinuous male closure elements having similar cross-sectional shapes are shown. The first closure strip 26 may have a number of closure elements, e.g., 42*a*-42*c*, equal to or less than the number of closure elements, e.g., 44*a*-44*d*, disposed on the second closure strip 40. The male closure elements, e.g., 42*a*-42*c*, of the first closure strip 26 and the male closure elements, e.g., 44*a*-44*d*, of the second closure strip 40 may be arranged in a linear pattern or they may be arranged in a random pattern, or, alternatively, the closure elements of the first closure strip may be arranged in linear pattern while the closure elements of the second closure strip are arranged in a random pattern, or vice versa. Each of the closure elements, e.g., 42*a*, may randomly engage two adjacent closure elements, e.g., 44*a* and 44*b*, on the opposite closure strip to form the closure. An exception, however, may exist for innermost and outermost closure elements, e.g., 44*a* and 44*d*, wherein these closure elements may engage only one other closure element. Wherein the male closure elements, e.g., 44*a*-44*d*, of the second closure strip 40 are arranged in a linear pattern, these elements may shift or slide along one or more of the discontinuous male closure elements, e.g., 42*a*-42*c*, of the first closure strip 26 when interlocked. This allows first and second bag walls 12, 14 to move relative to one another along a closure path.

This example and others are for illustrative purposes only, as closure may be achieved by one or more of the elements of the first closure strip engaging one or more of the closure elements of the second closure strip. For example, while FIG. 3 shows closure element 42*a* interengaging closure elements 44*a* and 44*b*, closure element 42*a* could alternatively engage closure elements 44*b* and 44*c*, defining an additional closure path, or closure elements 44*c* and 44*d*, defining yet an additional closure path.

Figure 4:
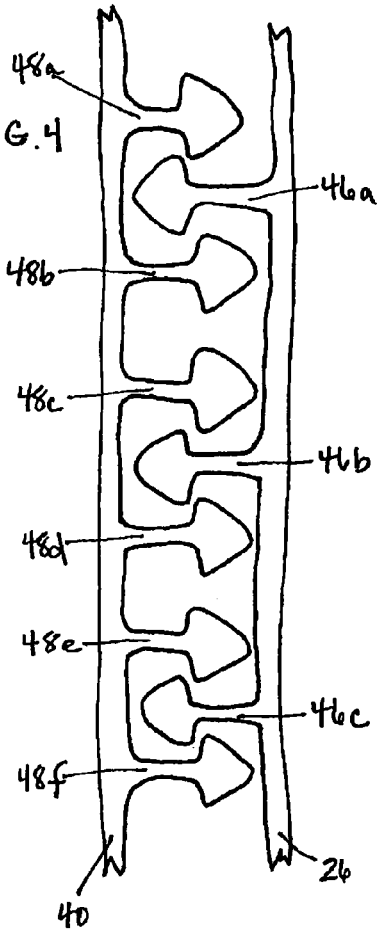
FIGS. 4-12 are enlarged, fragmentary, cross-sectional views similar to FIG. 3 illustrating alternative pairs of closure strips interlocked.

Alternatively, as shown in FIG. 4, the first closure strip 26 may have a number of discontinuous male closure elements, e.g., 46*a*-46*c*, substantially less than the number of discontinuous male closure elements, e.g., 48*a*-48*f*, of the second closure strip 40. The male closure elements, e.g., 46*a*-46*c*, of the first closure strip 26 and the male closure elements, e.g., 48*a*-48*f*, of the second closure strip 40 may be arranged in a linear pattern or they may be arranged in a random pattern, or, alternatively, the closure elements of the first closure strip may be arranged in linear pattern while the closure elements of the second closure strip are arranged in a random pattern, or vice versa. To facilitate closure a first closure element, e.g., 46*a*, of the first closure strip 26 may randomly engage first and second closure elements, e.g., 48*a* and 48*b*, of the second closure strip 40 and a second closure element, e.g., 46*b*, of the first closure strip 26 may randomly engage third and fourth closure elements, e.g., 48*c* and 48*d*, of the second closure strip 40. An exception, however, may exist for innermost and outermost closure elements, e.g., 48*a* and 48*f*. Wherein the male closure elements, e.g., 48*a*-48*f*, of the second closure strip 40 are arranged in a linear pattern, these elements may shift or slide along one or more of the discontinuous male closure elements, e.g., 46*a*-46*c*, of the first closure strip 26 when interlocked. This allows first and second bag walls 12, 14 to move relative to one another along a closure path.

Figure 5:
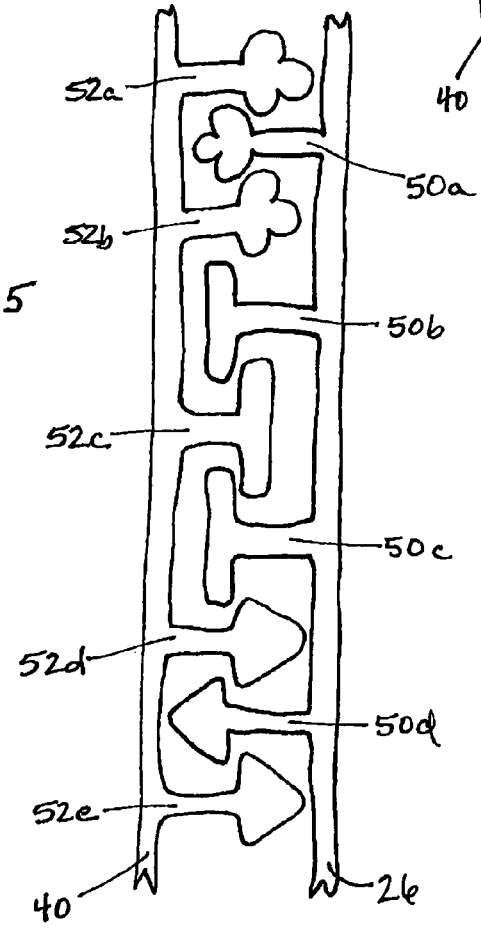

Yet alternatively, as shown in FIG. 5, the discontinuous male closure elements, e.g., 50*a*-50*d*, of the first closure strip 26 and the discontinuous male closure elements, e.g., 52*a*-52*e*, of the second closure strip 40 may have differing cross-sectional shapes and sizes. For example, the cross-sectional shapes may be, but are not necessarily, arrowhead-shaped, T-shaped, or clover-shaped. The male closure elements, e.g., 50*a*-50*d*, of the first closure strip 26 and the male closure elements, e.g., 52*a*-52*e*, of the second closure strip 40 may be arranged in a linear pattern or they may be arranged in a random pattern, or, alternatively, the closure elements of the first closure strip may be arranged in linear pattern while the closure elements of the second closure strip are arranged in a random pattern, or vice versa. Closure is formed in a manner similar to that described for FIG. 3.

Figure 6:
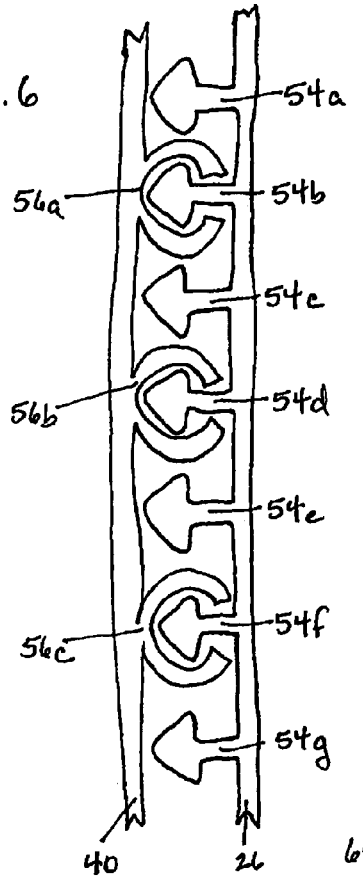
Figure 7:
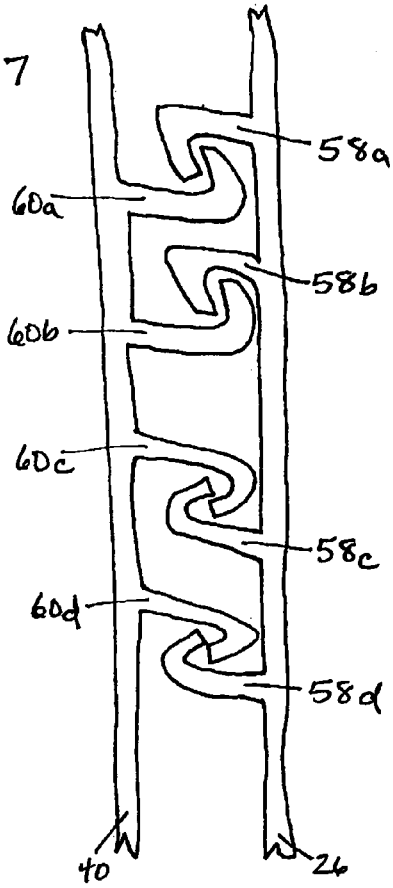

Turning now to FIG. 6, the discontinuous closure elements, e.g., 54*a*-54*g*, of the first closure strip 26 comprise male profiles, while the discontinuous closure elements, e.g., 56*a*-56*c*, of the second closure strip 40 comprise female profiles, or, more specifically, omega-shaped profiles. In this embodiment, the first closure strip 40 is comprised of more closure elements than the second closure strip 26. The male closure elements, e.g., 54*a*-54*g*, of the first closure strip 26 and the female closure elements, e.g., 56*a*-56*c*, of the second closure strip 40 may be arranged in a linear pattern or they may be arranged in a random pattern, or, alternatively, the closure elements of the first closure strip may be arranged in linear pattern while the closure elements of the second closure strip are arranged in a random pattern, or vice versa.

Yet alternatively, the male closure elements, e.g., 54*a*-54*g*, of the first closure strip 26 may be arranged in a linear pattern or a random pattern and one or more of the female closure elements, e.g., 56*a*-56*c*, of the second closure strip 40 may be continuous, extending from the first side portion 16 to the second side portion 18 of the bag 10. To facilitate closure, for example, the discontinuous or continuous female closure elements, e.g., 56*a*-56*c*, of the second closure strip 40 may randomly engage any of the discontinuous male closure elements, e.g., 54*a*-54*g*, of the first closure strip 26. The one or more continuous female closure elements, e.g., 56*a*-56*c*, of the second closure strip 40 may shift or slide along one or more of the discontinuous male closure elements, e.g., 54*a*-54*g*, when interlocked. This allows first and second bag walls 12, 14 to move relative to one another along a closure path.

In yet an alternative embodiment, the male closure elements, e.g., 54*a*-54*g*, of the first closure strip may be continuous and one or more of the female closure elements, e.g., 56*a*-56*c*, of the second closure strip 40 may be continuous. To facilitate closure, for example, the discontinuous or continuous female closure elements, e.g., 56*a*-56*c*, of the second closure strip 40 may randomly engage any of the continuous male closure elements, e.g., 54*a*-54*g*, of the first closure strip 26. The one or more continuous female closure elements, e.g., 56*a*-56*c*, of the second closure strip 40 may shift or slide along one or more of the continuous male closure elements, e.g., 54*a*-54*g*, when interlocked. This allows first and second bag walls 12, 14 to move relative to one another along a closure path.

FIGS. 7-10 show embodiments wherein the discontinuous closure elements comprise hook-shaped profiles. According to FIG. 7, the closure elements, e.g., 58*a*-58*d*, of the first closure strip 26 are hook-shaped and may face opposite directions. The second closure strip 40 contains an equal number of closure elements, e.g., 60*a*-60*d*. The hook-shaped closure elements, e.g., 58*a*-58*d*, of the first closure strip 26 and the hook-shaped elements, e.g., 60*a*-60*d*, of the second closure strip 40 may be arranged in a linear pattern or they may be arranged in a random pattern, or, alternatively, the closure elements of the first closure strip may be arranged in linear pattern while the closure elements of the second closure strip are arranged in a random pattern, or vice versa. To facilitate closure, for example, a first closure element, e.g., 58*a*, of the first closure strip 26 may randomly engage a first closure element, e.g., 60*a*, of the second closure strip 40. Wherein the hook-shaped closure elements, e.g., 60*a*-60*d*, of the second closure strip 40 are arranged in a linear pattern, these elements may shift or slide along one or more of the discontinuous hook-shaped closure elements, e.g., 58*a*-58*d*, of the first closure strip 26 when interlocked. This allows first and second bag walls 12, 14 to move relative to one another along a closure path.

Figure 8:
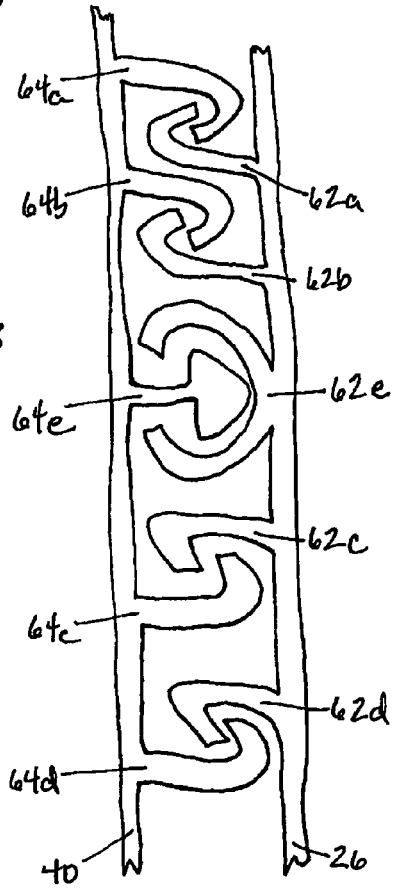

FIG. 8 illustrates a further embodiment wherein the first closure strip 26 comprises discontinuous hook-shaped closure elements, e.g., 62*a*-62*d*, and also one or more discontinuous omega-shaped female closure elements, for example, element 62*e*. Alternatively, one or more of the female closure elements, e.g., 62*e*, of the first closure strip 40 may be continuous, extending from the first side portion 16 to the second side portion 18 of the bag 10. The hook-shaped closure elements, e.g., 62*a*-62*d*, of the first closure strip may be arranged in a linear pattern or a random pattern. The second closure strip 40 comprises numerous discontinuous hook-shaped closure elements, e.g., 64*a*-64*d*, and a male closure element, e.g., 64*e*. The hook-shaped closure elements, e.g., 64*a*-64*d*, of the second closure strip may be arranged in a linear pattern or a random pattern. To facilitate closure, for example, a first closure element, e.g., 62*a*, of the first closure strip 26 may randomly interengage a first closure element, e.g., 64*a*, of the second closure strip 40. In addition, the male closure element, e.g., 64*e*, is capable of engaging the one or more female closure elements, e.g., 62*e*. Wherein the hook-shaped closure elements, e.g., 62*a*-62*d*, of the first closure strip 26 are arranged in a linear pattern, these elements may shift or slide along one or more of the discontinuous hook-shaped closure elements, e.g., 64*a*-64*d*, of the second closure strip 40 when interlocked. This allows first and second bag walls 12, 14 to move relative to one another along a closure path. In addition, the female closure element, e.g., 62*e*, may shift or slide along the male closure element, e.g., 64*e*.

Figure 9:
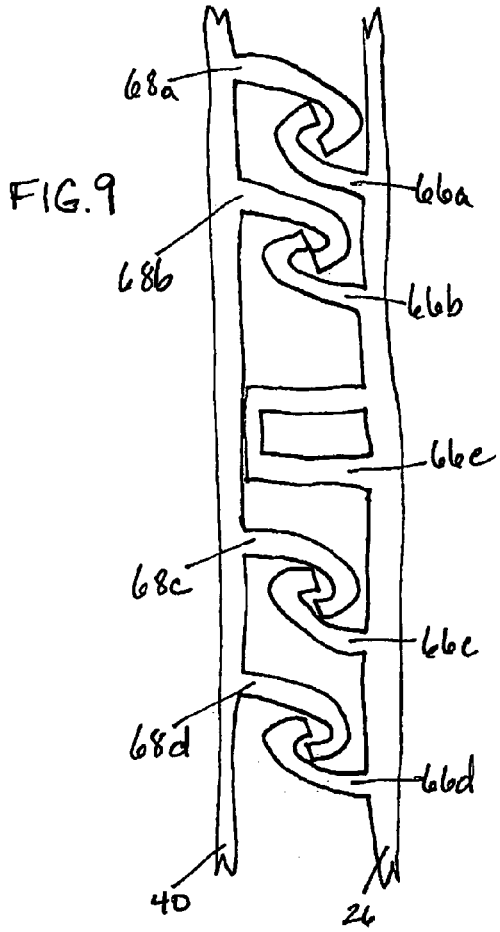
Figure 10:
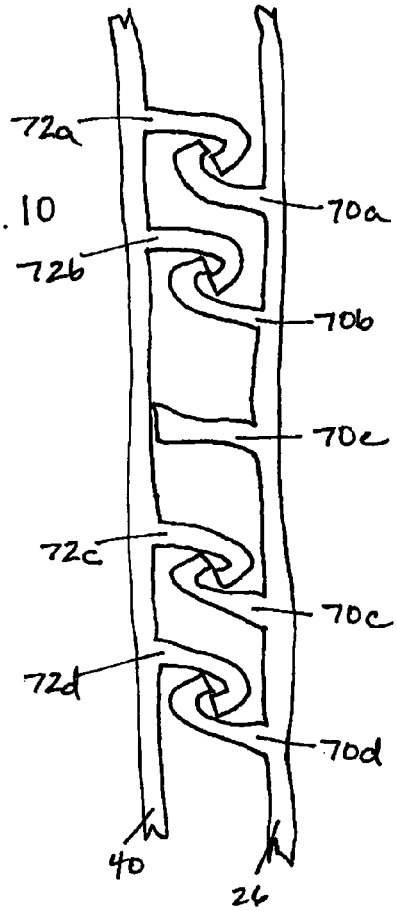

FIG. 9 illustrates a yet further embodiment wherein the first closure strip 26 comprises discontinuous hook-shaped closure elements, e.g., 66*a*-66*d*, and the second closure strip 40 comprises discontinuous hook-shaped closure elements, e.g., 68*a*-68*d*. The hook-shaped closure elements, e.g., 66*a*-66*d*, of the first closure strip 26 and the hook-shaped closure elements, e.g., 68*a*-68*d*, of the second closure strip 40 may be arranged in a linear pattern or they may be arranged in a random pattern, or, alternatively, the closure elements of the first closure strip may be arranged in linear pattern while the closure elements of the second closure strip are arranged in a random pattern, or vice versa. First closure strip 26 further includes one or more continuous square-shaped closure elements, for example, element 66*e*. To facilitate closure, for example, a first closure element, e.g., 66*a*, of the first closure strip 26 may randomly engage a first closure element, e.g., 68*a*, of the second closure strip 40. In addition, the square-shaped closure element 66*e* is capable of contacting the second closure strip 40 and preventing leakage through the closure. Similarly, as shown in FIG. 10, the first closure strip 26 comprises discontinuous hook-shaped closure elements, e.g., 70*a*-70*d*, and the second closure strip 40 comprises discontinuous hook-shaped closure elements, e.g., 72*a*-72*d*. However, the one or more continuous square-shaped closure elements of FIG. 9, is replaced with a columnar-shaped element 70*e*. According to FIGS. 9 and 10, wherein the hook-shaped closure elements, e.g., 70*a*-70*d*, of the first closure strip 26 are arranged in a linear pattern, these elements may shift or slide along one or more of the discontinuous hook-shaped closure elements, e.g., 72*a*-72*d*, of the second closure strip 40 when interlocked. This allows first and second bag walls 12, 14 to move relative to one another along a closure path.

Figure 11:
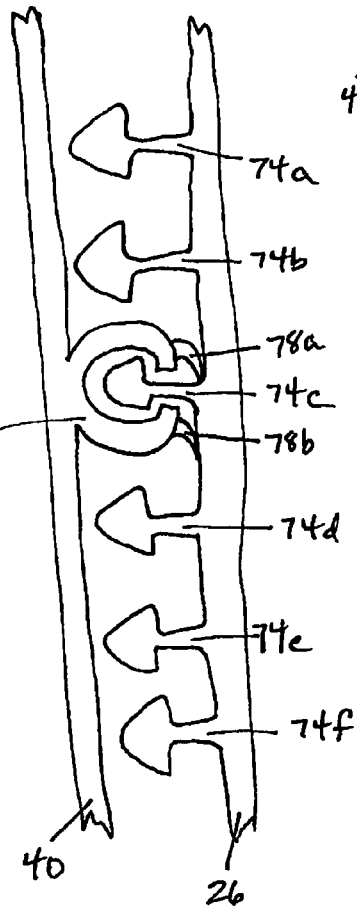
Figure 12:
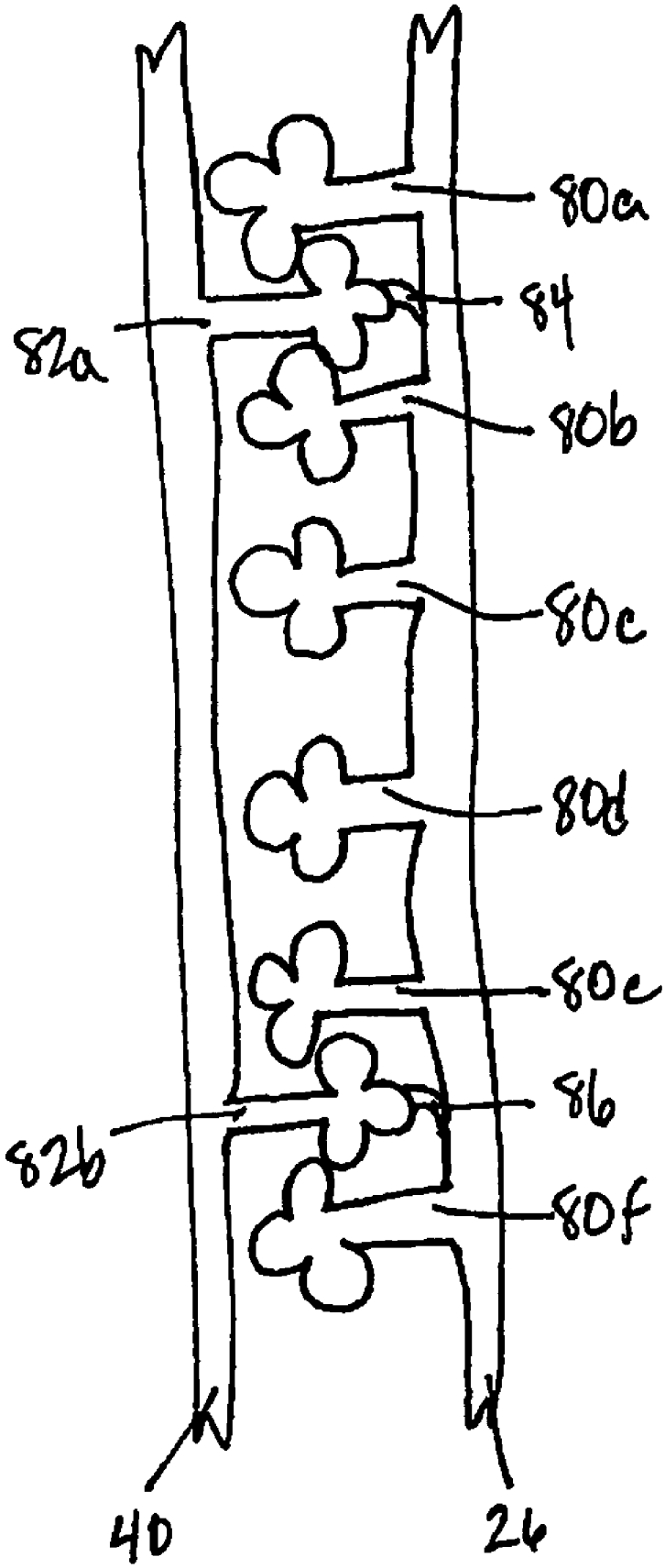

To further assist in leakage prevention, alternative embodiments are shown in FIGS. 11-12. According to FIG. 11, the discontinuous closure elements, e.g., 74*a*-74*f*, of the first closure strip 26 comprise male profiles, while the continuous closure element, e.g., 76, of the second closure strip 40 comprises a female profile, or, more specifically, an omega-shaped profile. The male closure elements, e.g., 74*a*-74*f*, of the first closure strip 26 may be arranged in a linear pattern or a random pattern. Angular or flap-shaped extensions, e.g., 78*a* and 78*b*, may be added to the top surface of the female closure element 76 to help prevent the transport of liquids and gases from the inside of the bag 10 to the outside of the bag when the bag is closed and/or the elements of the first and second closure strips are interlocked. The female closure element, e.g., 76, of the second closure strip 40 may shift or slide along one or more of the discontinuous male closure elements, e.g., 74*a*-74*f*, when interlocked. This allows first and second bag walls 12, 14 to move relative to one another along a closure path.

Turning now to FIG. 12, the discontinuous closure elements, e.g., 80*a*-80*f*, of the first closure strip 26 comprise male profiles and the one or more continuous closure elements, e.g., 82*a* and 82*b*, of the second closure strip 40 comprises a male profile. The male closure elements, e.g., 80*a*-80*f*, of the first closure strip 26 may be arranged in a linear pattern or a random pattern. Angular or flap-shaped extensions, e.g., 84 and 86, may be added to the top surface of the male closure elements 82*a* and 82*b* to help prevent the transport of liquid and gases from the inside of the bag 10 to the outside of the bag when the bag is closed and/or the elements of the first and second closure strips are interlocked. The male closure elements, e.g., 82*a* and 82*b*, of the second closure strip 40 may shift or slide along one or more of the discontinuous male closure elements, e.g., 80*a*-80*f*, when interlocked. This allows first and second bag walls 12, 14 to move relative to one another along a closure path.

A resealable bag useful in the present invention can be made by various techniques known to those skilled in the art including those described in, for example, Geiger, et al., U.S. Pat. No. 4,755,248. Other useful techniques to make a resealable bag of the present invention include those described in, for example, Zieke et al., U.S. Pat. No. 4,741,789. Other useful techniques to make a resealable bag of the present invention include those described in, for example, Porchia et al., U.S. Pat. No. 5,012,561. Additional examples of making a resealable bag as described herein include, for example, a cast post applied process, a cast integral process, and/or a blown process.

Illustratively, the resealable bag walls of the present invention can be made of any flexible material suitable for packaging a sample, article, and/or substance, including, for example, any suitable thermoplastic film. A flexible material useful in the present invention includes, for example, polyethylene (for example, low density polyethylene, and linear low density polyethylene), substantially linear copolymers of ethylene and a $C_3$-$C_8$ alpha-olefin, polypropylene, polyvinylidene chloride, polyvinyl chloride, vinyl, and/or other polymers, in single or multiple layer, and combinations thereof. Additionally, the resealable bag walls can be constructed of any flexible material including, for example, paper and/or metal, including, for example, aluminum foil or sheets. The flexible material may be transparent or semi-transparent (to permit viewing of the sample, article, and/or substance in the resealable bag), translucent, lucent, clear, and/or opaque, at least in part, depending on the application in which the resealable bag will be utilized.

Also illustratively, any of the closure elements described herein may be extruded by any convenient extrusion process from a thermoplastic material similar to that used for the bag walls, or any other extrudable material suitable for forming a resealable closure element. The closure elements could also be formed by other suitable processes, such as by hand forming, molding, carving, etching, aggregation, accumulation, or microreplication, and of other materials such as wax, rubber, metal, cloth, or plastic.

The discontinuous closure elements, as described herein, or, more specifically, the interruption of closure elements may be accomplished through any suitable cutting means that can remove pieces of the closure strips. These may include a rotating gear, wherein teeth of the gear have a cutting edge, which tears away material as it rotates and as the closure strip passes below. An additional cutting means comprises a rotating gear that segments the closure strip. The segmented closure strip then passes over a roll, which flexes the closure strip, causing the segmented regions to open up, forming an opening. An oscillating cutting tool may then be used to cut away alternating segments. An alternative to cutting portions from the closure strips is to stomp intermittent sections of the closure, leaving independent members standing. The stomping may be accomplished by known thermal or ultrasonic means.

Two or more surfaces described herein may be attached together in a permanent or non-permanent manner by any fastening, securing, and/or joining techniques known to those skilled in the art. Examples include mechanically, chemically, and/or heat fastening, securing, and/or joining together two or more surfaces of metal, plastic, glass, rubber, paper, and/or ceramic, and combinations thereof. A chemical agent useful in the present invention to fasten, secure, and/or join two or more surfaces includes, for example, an adhesion promoter, a binding agent (for example, a cyanoacrylate adhesive, or an epoxy putty), a bonding agent (for example, a hot melt adhesive), a crosslinking agent, a curing agent (for example, a UV light curing adhesive), a fixative agent, a sticking agent, and/or a vulcanizing agent, and combinations thereof. Exemplary chemical agents useful in the present invention include those described in, for example, The Handbook of Industrial Chemical Additives—2nd Edition, Gower Publishing Limited (Mar. 28, 1998). Additional examples of chemical agents useful in the present invention include those described in the Merck Index, Thirteenth Edition, John Wiley & Sons, 13th edition (October 2001). Heat fastening, securing, and/or joining techniques useful in the present invention include, for example, ultrasound, heat or sonic staking, and/or laser welding or joining techniques. Mechanical techniques useful in the present invention, include, for example, the use of tabs, protrusions, hooks, clamps, fasteners, ties, fastening strips (for example, Velcro®), adhesive tape (for example, two sided tape), rivets, soldering, brazing, and/or welding, and combinations thereof. Combinations of the above fastening, securing, and/or joining techniques and agents can be used in the present invention.

INDUSTRIAL APPLICABILITY

The embodiments of the thermoplastic storage pouch as described herein advantageously provide the consumer with a pouch and a closure mechanism therefor, wherein the closure mechanism comprises a plurality of discontinuous closure elements. The existence of multiple closure elements provides for multiple closure paths. This minimizes the need for consumers to line up the closure strips of the closure mechanism in order to close the pouch, as is required by the prior art. Additionally, the closure strips described herein have a greater surface area than traditional closure strips for improved ease of closure.

Numerous modifications will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications, which come within the scope of the appended claims, are reserved.

We claim:

1. A resealable closure mechanism, comprising:

a first closure strip including a plurality of discontinuous closure elements; and a second closure strip including a plurality of discontinuous closure elements;

wherein one or more of the discontinuous closure elements of the first closure strip randomly engages one or more of the discontinuous closure elements of the second closure strip; and wherein the discontinuous closure elements of the first closure strip are arranged in rows extending along a width of the closure strip; and wherein the discontinuous closure elements of the first closure strip may shift or slide along the discontinuous closure elements of the second closure strip when the elements are engaged.

2. The closure mechanism of claim 1, wherein the discontinuous closure elements of the first closure strip are further arranged in columns extending along a height of the closure strip.

3. The closure mechanism of claim 2, wherein the discontinuous closure elements of the second closure strip are arranged in columns extending along a height of the closure strip and further arranged in rows extending along a width of the closure strip.

4. The closure mechanism of claim 1, wherein the discontinuous closure elements of the first closure strip comprise male profiles and the discontinuous closure elements of the second closure strip comprise female profiles.

5. The closure mechanism of claim 1, wherein the discontinuous closure elements of the first closure strip and the second closure strip comprise male profiles.

6. The closure mechanism of claim 1, wherein the discontinuous closure elements of at least one of the first and second closure strips are staggered to prevent a straight passage from a top portion of the closure strips to a bottom portion of the closure strips when the elements of the first and second closure strips are engaged.

7. The closure mechanism of claim 1, wherein the first closure strip further includes at least one continuous element.

8. The closure mechanism of claim 7, wherein the second closure strip further includes at least one continuous element.

9. The closure mechanism of claim 1, wherein the number of elements of the first closure strip is greater than the number of elements of the second closure strip.

10. A resealable closure mechanism, comprising:

a first closure strip including a plurality of discontinuous closure elements; and a second closure strip including at least one continuous closure element;

wherein the at least one continuous closure element of the second closure strip randomly engages one or more of the discontinuous elements of the first closure strip;

wherein the one or more continuous closure elements of the second closure strip may shift or slide along the discontinuous closure elements of the second closure strip when the elements are engage; and wherein the discontinuous closure elements of the first closure strip are arranged in a plurality of rows extending along a width of the closure strip.

11. The closure mechanism of claim 10, wherein the at least one continuous closure element of the second closure strip comprises a female profile.

12. The closure mechanism of claim 10, wherein the at least one continuous closure element of the second closure strip comprises a male profile.

13. The closure mechanism of claim 10, wherein the at least one continuous closure element of the second closure strip further comprises an angular extension configured to engage the first closure strip.

14. The closure mechanism of claim 10, wherein the discontinuous closure elements of the first closure strip are arranged in columns extending along a height of the closure strip.

15. The closure mechanism of claim 10, wherein the discontinuous closure elements of the first closure strip comprise male profiles.

16. The closure mechanism of claim 15, wherein the discontinuous closure elements further comprise various cross-sectional shapes.

* * * * *

UNITED STATES PATENT AND TRADEMARK OFFICE

CERTIFICATE OF CORRECTION

PATENT NO. : 7,340,807 B2
APPLICATION NO. : 11/047002
DATED : March 11, 2008
INVENTOR(S) : Brian C. Dais and Robert R. Turvey It is certified that error appears in the above-identified patent and that said Letters Patent is hereby corrected as shown below:

Column 10, Line 37: replace “engage” with --engaged--

Signed and Sealed this

Eleventh Day of November, 2008

JON W. DUDAS
*Director of the United States Patent and Trademark Office*